US009714653B2

(12) United States Patent
Hashimoto

(10) Patent No.: US 9,714,653 B2
(45) Date of Patent: Jul. 25, 2017

(54) ELECTRIC VEHICLE AND CONTROL METHOD FOR ELECTRIC VEHICLE

(71) Applicant: Hironobu Hashimoto, Toyota (JP)

(72) Inventor: Hironobu Hashimoto, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 13/649,749

(22) Filed: Oct. 11, 2012

(65) Prior Publication Data

US 2013/0096756 A1 Apr. 18, 2013

(30) Foreign Application Priority Data

Oct. 14, 2011 (JP) ..... 2011-226592

(51) Int. Cl.
*F04B 49/02* (2006.01)

(52) U.S. Cl.
CPC ..... *F04B 49/02* (2013.01)

(58) Field of Classification Search
CPC ..... F04B 49/02; F04B 49/00
USPC ..... 701/22
See application file for complete search history.

(56) References Cited

U.S. PATENT DOCUMENTS 4,733,145 A * 3/1988 Ohashi et al. ..... 318/54
2002/0073726 A1* 6/2002 Hasebe et al. ..... 62/323.1
2003/0100975 A1* 5/2003 Hashimoto et al. ..... 701/1
2005/0244691 A1* 11/2005 Varenne ..... 429/26
2007/0212598 A1* 9/2007 Iida et al. ..... 429/62
2009/0195093 A1* 8/2009 Bandai et al. ..... 310/54
2010/0315780 A1* 12/2010 Murakami ..... 361/699
2011/0093150 A1* 4/2011 Yanagisawa ..... B60W 20/13 701/22
2011/0106358 A1* 5/2011 Sawada ..... B60K 11/02 701/22
2011/0178665 A1* 7/2011 Yoshioka ..... B60W 10/06 701/22
2011/0288743 A1* 11/2011 Smith ..... F02N 11/0803 701/102
2012/0299378 A1* 11/2012 King et al. ..... 307/18
2013/0116871 A1* 5/2013 Hashimoto ..... B60L 11/1803 701/22

FOREIGN PATENT DOCUMENTS

JP 10-257604 A 9/1998
JP 2007-216833 A 8/2007
JP 2008-213583 A 9/2008
JP 2009-040322 A 2/2009
JP 2009-067087 A 4/2009
JP 2009-261197 A 11/2009
JP 2011-093424 A 5/2011

* cited by examiner

*Primary Examiner* — Michael McCullough
*Assistant Examiner* — Michael E Butler
(74) *Attorney, Agent, or Firm* — Dinsmore & Shohl LLP

(57) ABSTRACT

An electric vehicle includes: a wheel drive motor; an inverter that supplies electric power to the motor; a pump that delivers refrigerant to the motor and the inverter; and a controller that controls the pump. When a main switch of the vehicle is at an ON position, the controller limits the pump output at or below a predetermined pump output upper limit value, and, when the main switch is switched to an OFF position while travelling, the controller drives the pump at an output higher than the pump output upper limit value irrespective of the pump output upper limit value.

14 Claims, 5 Drawing Sheets

FIG. 3

| REFRIGERANT TEMPERATURE [°C] | NORMAL MODE | EMERGENCY MODE |
|---|---|---|
| ~10 | STOP | SUPER Hi |
| ~30 | Lo | |
| ~60 | Mid | |
| 60~ | Hi | |

ELECTRIC VEHICLE AND CONTROL METHOD FOR ELECTRIC VEHICLE

INCORPORATION BY REFERENCE

The disclosure of Japanese Patent Application No. 2011-226592 filed on Oct. 14, 2011 including the specification, drawings and abstract is incorporated herein by reference in its entirety.

BACKGROUND OF THE INVENTION

1. Field of the Invention

The invention relates to an electric vehicle that includes a motor that is able to regenerate electric power from kinetic energy of the vehicle and a control device for the electric vehicle. The electric vehicle in the specification also includes a hybrid vehicle that includes an engine together with such a motor, and a fuel cell vehicle.

2. Description of Related Art

An electric vehicle, different from an existing engine vehicle, includes an electrical system that handles large current. The electrical system includes a motor that is able to regenerate electric power from kinetic energy of the vehicle, a large-capacity large-current battery, an inverter that converts direct-current power of the battery to alternating-current power suitable for driving the motor, and the like. Therefore, various safety measures and preventive measures, which are not equipped for an engine vehicle, are taken. Note that the motor that is able to regenerate electric power from kinetic energy of the vehicle may also serve as a wheel drive motor (that is, a motor that serves as a device that generates driving force).

For example, Japanese Patent Application Publication No. 2007-216833 describes a technique for preventing the following situation. When an engine stop signal is input to a control device while a hybrid vehicle is travelling, the engine is forcibly stopped, so large current flows through a motor, and the amount of discharge of a main battery exceeds an upper limit, causing a decrease in battery service life.

There is one of measures peculiar to an electric vehicle for a situation that a driver erroneously switches a main switch of the vehicle to the OFF position or returns the main switch to the ON position again while travelling. Here, the main switch of the vehicle means a switch provided at a driver seat and is generally called "ignition switch". In the case of an electric vehicle, when the main switch is at the ON position, a relay that connects the inverter to the main battery is closed (the main battery is connected to an electrical system of the motor), and the motor is being driven or is in a drivable state. When the main switch is at the OFF position, the relay between the inverter and the main battery is open, and supply of electric power to the motor is stopped. In the case of a hybrid vehicle that includes a motor and an engine, when the main switch is at the ON position, a relay that connects the inverter to the main battery is closed (the electrical system of the motor is connected to the main battery), the motor is being driven or is in a drivable state, and the engine is also being driven or in a drivable state. At the OFF position, supply of electric power to the motor is stopped, and supply of fuel to the engine is also stopped. In addition, in the electric vehicle (including a hybrid vehicle), when the main switch of the vehicle is at the OFF position, an overall system associated with a drive system is stopped. Here, the system associated with the drive system typically includes an inverter and a cooling system for the inverter or a motor. Hereinafter, for the sake of simple description, switching the main switch of the vehicle from the ON position to the OFF position is referred to as "ON/OFF switching", and switching the main switch from the OFF position to the ON position again is referred to as "OFF/ON switching".

ON/OFF switching of the main switch while travelling is not a normal usage mode; however, the driver may erroneously conduct such an operation. When the main switch is switched from the ON position to the OFF position, supply of electric power to the motor (and supply of fuel to the engine), the inverter and the cooling system are stopped, but the motor continues rotating by the inertia force of the vehicle. When OFF/ON switching of the main switch is performed again while travelling, the inverter and the cooling system start up in a state where the motor is rotating. As a result, upon OFF/ON switching, a high load may is applied to the inverter and the cooling system. For example, when the inverter starts up while the motor is rotating due to coasting of the vehicle, the function of recovering regenerative electric power is activated, and the inverter operates to convert counter electromotive force, generated by the motor, to direct-current power. A high load is applied to the inverter immediately after OFF/ON switching of the main switch, and the inverter generates heat. In addition, while the main switch is OFF, motor coils form an open system because the main relay that connects the inverter to the battery is open, so no current (counter electromotive force) flows; whereas the motor coils form a closed system when the main relay is closed, so counter electromotive force flows. Then, the motor itself also generates heat. As described above, when OFF/ON switching of the main switch is performed while travelling, the cooling system of the inverter (and/or the motor) has just started up, so a response to steep heat generation of the inverter (and/or the motor) delays.

SUMMARY OF THE INVENTION

The invention provides a technique for suppressing an increase in temperature by taking measures against steep heat generation of an inverter (and/or a motor) in the case where a main switch of a vehicle is switched from an ON position to an OFF position and then switched to the ON position again while travelling.

An electric vehicle includes a cooling system that cools an inverter and/or a motor. In many electric vehicles, the cooling system circulates refrigerant between those devices and a radiator. Refrigerant is typically liquid long life coolant (LLC). The cooling system uses a pump to circulate refrigerant.

Normally, when a main switch is OFF, a controller (controller that controls the pump) stops the pump. Then, in order to take measures against steep heat generation of the inverter (and/or the motor) at the time of OFF/ON switching while travelling, in an aspect of the invention, when the main switch of the vehicle is at the OFF position, the controller activates the pump while the vehicle is travelling and stops the pump when the vehicle is stopped. The main switch may be provided at a driver seat. While the vehicle is travelling, the pump remains activated even when the main switch is OFF. This is in preparation for steep heat generation after OFF/ON switching. Note that while the vehicle is travelling (while travelling) includes the case where the motor (and the engine) is stopped and the vehicle is coasting. That is, it means the case where the vehicle speed is not zero.

When large heat generation is expected after OFF/ON switching of the main switch while travelling, a pump output in the case where the vehicle is travelling and the main switch of the vehicle is at the OFF position may be increased above a pump output in the case where the vehicle is travelling and the main switch of the vehicle is at the ON position. When large heat generation is expected after OFF/ON switching while travelling, the pump output is increased in advance of heat generation, and, by making preparations for heat generation thereafter, it is possible to suppress an increase in temperature at the time of heat generation. Note that "the case where large heat generation is expected after OFF/ON switching while travelling" is typically the case where the vehicle speed is higher than a predetermined vehicle speed threshold. When the vehicle speed is high, the rotation speed of the motor increases, and large heat generation is expected. More generally, "the case where large heat generation is expected after OFF/ON switching while travelling" is determined on the basis of a vehicle state associated with heat generation, such as a vehicle speed, an inverter temperature (a motor temperature) and a refrigerant temperature.

In addition, in many electric vehicles, the output of the pump is usually limited to a certain degree so that the pump of the cooling system is usable for a long time (so that the service life of the pump is not reduced). That is, in a normal travelling state, the controller that controls the pump such that the pump output is limited to at or below a predetermined upper limit value (pump output upper limit value). Note that the pump output is a pump rotation speed (rotation speed command value), a pump output torque (torque command value), a driving voltage applied to the pump, or the like. That is, the pump output upper limit value can also be such a physical unit system (rotation speed, torque, voltage).

In another aspect of the invention, in the case of an abnormal state where the main switch is switched from the ON position to the OFF position while travelling, the pump is driven while exceeding the pump output upper limit value to which the pump output is limited. Specifically, an electric vehicle according to the aspect of the invention may include: a pump that delivers refrigerant to at least one of a motor and an inverter; and a controller that controls the pump, wherein, when a main switch of the vehicle is at an ON position, the controller may limit a pump output at or below a predetermined pump output upper limit value, and, when the main switch is at an OFF position (switched to an OFF position) while travelling, the controller may drive the pump at an output higher than a pump output upper limit value irrespective of the pump output upper limit value. When the main switch is switched to the OFF position while travelling, the pump is driven at an output higher than that during normal times, and the inverter and/or the motor is actively cooled. This is in preparation for steep heat generation of the inverter or the motor at the time when OFF/ON switching is performed again.

The controller may monitor at least one of a temperature of the inverter, a temperature of the motor and a temperature of the refrigerant, and, when the monitored temperature becomes lower than a predetermined threshold, the controller may limit the pump output at or below the pump output upper limit value. When cooling has progressed to some degree, the pump output may be limited at or below the original pump output upper limit value to suppress degradation of the pump or power consumption.

Not the above-described measures taken at the time of OFF switching, the pump output may be increased in the case where the main switch is switched from the OFF position to the ON position while travelling.

Further another aspect of the invention relates to a control method for an electric vehicle that includes: a motor that is able to regenerate electric power from kinetic energy of the vehicle; an inverter that supplies electric power to the motor; and a pump that delivers refrigerant to at least one of the motor and the inverter. The control method includes, when a main switch of the vehicle is at an OFF position, activating the pump while the vehicle is travelling, and stopping the pump when the vehicle is stopped.

Further another aspect of the invention relates to a control method for an electric vehicle that includes: a motor that is able to regenerate electric power from kinetic energy of the vehicle; an inverter that supplies electric power to the motor; and a pump that delivers refrigerant to at least one of the motor and the inverter. The control method includes, when a main switch of the vehicle is switched from an OFF position to an ON position while travelling, increasing a pump output.

The details of the above-described techniques and further improvements will be described in details in the following embodiments of the invention.

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

FIG. 3 shows an example of a control mode of a pump;

DETAILED DESCRIPTION OF EMBODIMENTS

Figure 1:
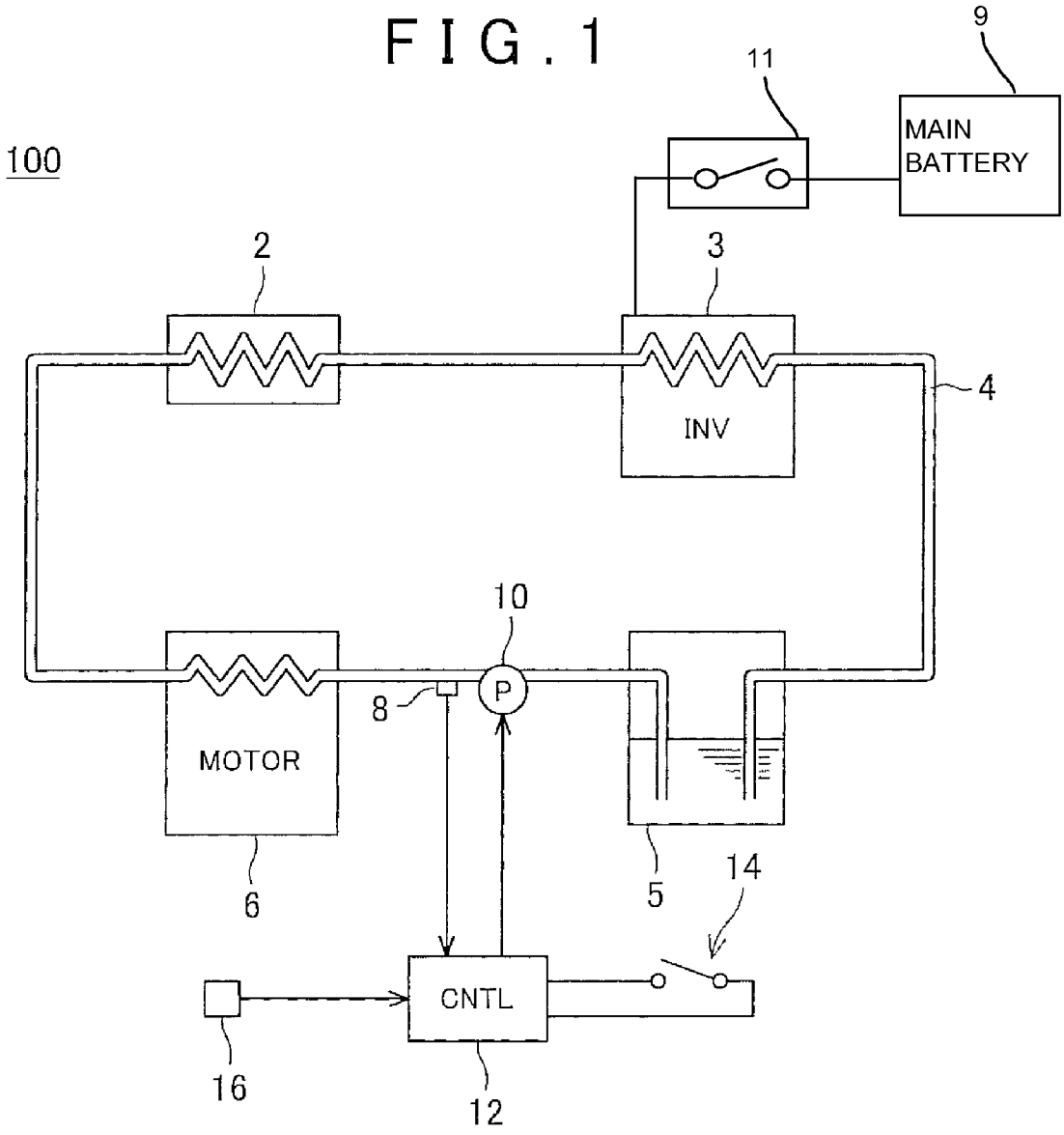
FIG. 1 is a block diagram of a cooling system of an electric vehicle according to an embodiment.

FIG. 1 shows a block diagram of a cooling system 100 of an electric vehicle. The electric vehicle according to the present embodiment is a single-motor electric vehicle that includes one wheel drive motor. The cooling system 100 of the electric vehicle cools a motor 6 and an inverter 3 that supplies alternating-current power to the motor 6. The cooling system 100 includes a refrigerant flow passage 4 that circulates refrigerant among the motor 6, the inverter 3, a radiator 2 and a reservoir tank 5. A pump 10 that delivers refrigerant is connected in the refrigerant flow passage 4. A temperature sensor 8 is installed near the pump 10. The temperature sensor 8 measures the temperature of refrigerant. The refrigerant temperature measured by the temperature sensor 8 is transmitted to a controller 12. The controller 12 adjusts the output of the pump 10 such that the refrigerant temperature falls within a predetermined temperature range during normal travelling. That is, the output of the pump 10 is increased when the refrigerant temperature is high, and the pump output is reduced when the refrigerant temperature falls within the predetermined temperature range. In addition, the controller 12 increases the pump output when the output of the inverter 3 is large because it is expected that the temperature of the inverter 3 increases thereafter. Note that the controller 12 issues a command for a driving voltage applied to the pump 10. That is, when the driving voltage command value issued from the controller 12 is high, the pump output increases; whereas, when the driving voltage command value is low, the pump output decreases.

A vehicle speed sensor 16 and a main switch 14 of the vehicle are connected to the controller 12. The main switch 14 is provided at a driver seat. The main switch 14 will be described. The main switch 14 is a so-called ignition switch. The main switch 14 is of a rotary type, and can be at the following three-step positions.

(1) OFF: The vehicle system is completely stopped (however, devices that constantly require current supply, such as a clock and a security system, are supplied with electric power).

(2) ACC-ON (Ready-OFF): This is a so-called accessory-on state, and electric power can be supplied to an audio, a room light, an air conditioner, and the like (however, switches of those devices are OFF, those devices are not activated). Note that a system main relay 11 that connects the main battery 9 to the inverter 3 remains open (that is, the main battery 9 and the motor electrical system remain interrupted from each other), and no electric power is supplied to a travelling drive system.

(3) Ready-ON: When the main switch is switched to this position, the system main relay 11 is closed (the main battery 9 and the motor electrical system, i.e. the inverter 3, are connected to each other). In this state, electric power can be supplied to the inverter 3. However, unless switching elements in the inverter 3 are activated, no electric power is supplied to the motor 6. When an accelerator is depressed in this state, the inverter 3 is activated, the motor 6 is driven, and the vehicle starts travelling. In addition, when the accelerator operation amount becomes zero while travelling, the main battery 9 is charged with counter electromotive force generated in the motor 6.

The main switch 14 of the vehicle can be at the above-described three positions. In the specification, when the main switch 14 is at the Ready-ON position, it is simply referred to as "the main switch 14 is at the ON position" (or the main switch 14 is ON), and, when the main switch 14 is at the Ready-OFF position or the OFF position, it is collectively referred to as "the main switch 14 is at the OFF position" (or the main switch 14 is OFF). When the main switch 14 is switched from the ON position to the OFF position, the battery is isolated from the motor electrical system (travelling drive system), and the inverter 3 is also completely stopped. Furthermore, in an existing electric vehicle, the cooling system is also completely stopped. That is, supply of electric power to the pump 10 is interrupted, and the pump 10 is also stopped.

While the vehicle is travelling, the main switch 14 should not be switched to the OFF position; however, occasionally, the driver may erroneously switch the main switch 14 to the OFF position while travelling. The driver who realizes that the main switch 14 is erroneously switched to the OFF position immediately returns the main switch 14 to the ON position again. That is, it can happen that the main switch 14 is switched from ON to OFF and then to ON again while travelling. When the main switch 14 is switched to the OFF position while travelling, the motor continues rotating through coasting of the vehicle; however, all the functions of the travelling system are stopped in the existing art. Particularly, the cooling system is stopped. When the main switch 14 is switched to the ON position again, because the motor 6 is rotating through inertia, the motor 6 outputs large regenerative electric power, and the inverter 3 converts the large regenerative electric power to direct-current power. As soon as the main switch 14 is switched to the ON position, the motor 6 and the inverter 3 start operating, and generate heat. On the other hand, the cooling system has just started up, and a response to heat generation of the motor 6 and the inverter 3 delays. The technique described in the specification covers a delay of response of the cooling system resulting from OFF/ON switching of the main switch 14 while travelling.

Figure 2:
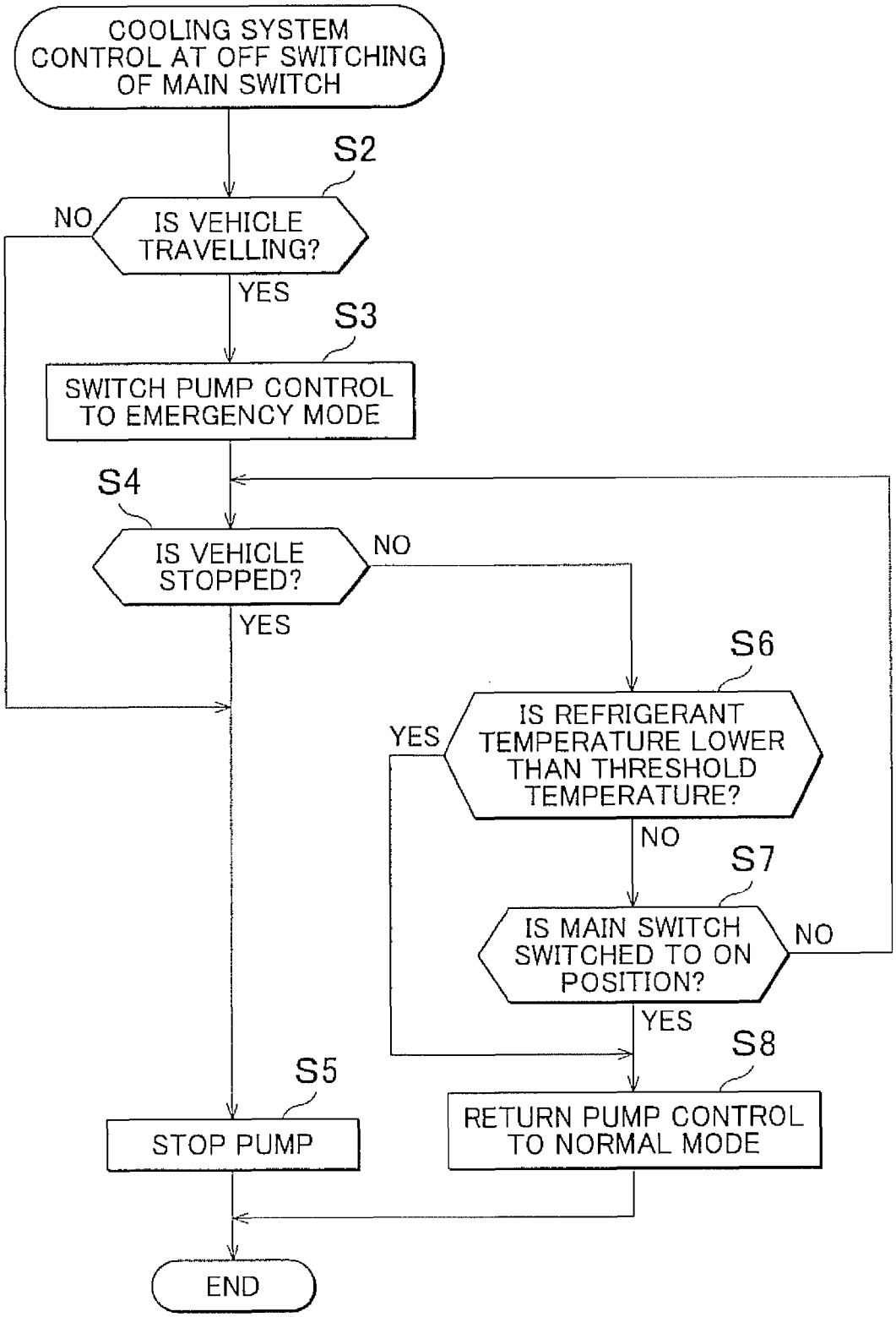
FIG. 2 is a flowchart of control over the cooling system.

The process executed by the controller 12 will be described with reference to the flowchart shown in FIG. 2. The process of FIG. 2 is started when the main switch 14 is switched from ON to OFF. The controller 12 initially checks whether the vehicle is travelling (S2). This checking is based on sensor data from the vehicle speed sensor 16 (see FIG. 1). Note that the controller 12 may be configured to determine that the vehicle is stopped when the vehicle speed is lower than a predetermined vehicle speed, such as 5 [km/h], even when the vehicle speed is not exactly zero. When the vehicle is stopped (NO in S2), the controller 12 stops the pump 10 to end the process (S5). When the vehicle is travelling (YES in S2), the controller 12 switches output control over the pump 10 from a normal mode used during normal times to an emergency mode (S3). Here, "during normal times" means when the main switch 14 is at the ON position. FIG. 3 shows an example of control modes of the pump. The controller 12 switches the output of the pump 10 on the basis of the temperature of refrigerant during normal times. In general, the controller 12 increases the output of the pump 10 as the refrigerant temperature increases. For example, the controller 12 stops the pump 10 when the refrigerant temperature is lower than or equal to 10 [° C.]. When the refrigerant temperature is higher than 10 [° C.] and lower than or equal to 30 [° C.], the pump 10 is driven at "Lo" output. When the refrigerant temperature is higher than 30 [° C.] and lower than or equal to 60 [° C.], the pump 10 is driven at "Mid" output. When the refrigerant temperature exceeds 60 [° C.], the pump 10 is driven at "Hi" output. Here, the output of the pump 10 has such a relationship that "Hi">"Mid">"Lo" (>"Stop"). Note that the pump output depends on a driving voltage applied to the pump 10 by the controller 12. Thus, in other words, the driving voltage applied to the pump 10 by the controller 12 has such a relationship that "Hi">"Mid">"Lo" (>"Stop").

As shown in FIG. 3, in the emergency mode, the controller 12 drives the pump 10 at "super Hi" output irrespective of the refrigerant temperature. Here, the pump output "super Hi" is higher than "Hi". That is, when the main switch 14 is at the ON position, the controller 12 limits the output of the pump 10 at or below a predetermined pump output upper limit value (which corresponds to "Hi" in FIG. 3), and, when the main switch 14 is switched to the OFF position while travelling, the controller 12 drives the pump at an output (which corresponds to "super Hi" in FIG. 3) higher than the pump output upper limit value irrespective of the pump output upper limit value.

Referring back to FIG. 3, the description of control over the cooling system is continued. After control over the pump 10 is switched to the emergency mode (S3), the controller 12 monitors whether the vehicle is stopped (S4). When the vehicle is stopped (YES in S4), the controller 12 stops the pump 10 (S5), and ends the process. Note that, when the pump 10 is stopped, the controller 12 returns the control mode switched in step S3 from the emergency mode to the normal mode in preparation for the case where the main switch 14 is switched to ON next time.

After pump control is switched to the emergency mode (S3), when the refrigerant temperature becomes lower than a predetermined threshold temperature even while travelling (YES in S6), the controller 12 returns control over the pump 10 to the normal mode, and returns to pump control during normal travelling (S8). When the refrigerant temperature is sufficiently low, it is not necessary to excessively cool the motor 6 and the inverter 3 by keeping the pump output at "super Hi". Here, the predetermined threshold temperature is, for example, 10 [° C.]. As shown in FIG. 3, in the normal mode, when the refrigerant temperature is lower than 10 [° C.], the pump 10 is stopped, so, when affirmative determination is made in step S6 and the process proceeds to step S8, the controller 12 stops the pump 10.

In addition, after the main switch 14 is switched from the ON position to the OFF position, even when the refrigerant temperature is not lower than the predetermined threshold temperature (NO in S6), when the main switch 14 is switched to the ON position again while the vehicle is travelling (YES in S7), the controller 12 returns control over the pump 10 to the normal mode, and returns to pump control during normal travelling (S8).

The advantage of the above-described control over the cooling system will be described. When the main switch 14 is switched from the ON position to the OFF position, while the vehicle is travelling, the controller 12 drives the pump 10 at an output higher than the output upper limit value during normal travelling irrespective of pump control during normal travelling (when the main switch 14 is ON). Through the above process, the inverter 3 and the motor 6 are quickly cooled. When the main switch 14 is switched from the ON position to the OFF position and then switched to the ON position again while travelling, the inverter 3 and the motor 6 steeply generate heat as described above. However, the temperatures of the inverter 3 and the motor 6 are sufficiently low, so an increase in the temperatures of the inverter 3 and the motor 6 is suppressed.

When the refrigerant temperature becomes lower than the predetermined threshold, the controller 12 limits the pump output at or below the pump output upper limit value (YES in S6, and S8). When the refrigerant temperature has decreased to some degree, the pump output is limited at or below the original pump output upper limit value to suppress degradation of the pump or power consumption.

The process of step S2 corresponds to activating the pump 10 when the main switch 14 of the vehicle, provided at the driver seat, is at the OFF position and the vehicle is travelling (YES in S2) and stopping the pump 10 when the vehicle is stopped (NO in S2).

Furthermore, the process of step S3 subsequent to step S2 corresponds to increasing the pump output in the case where the vehicle is travelling and the main switch 14 of the vehicle, provided at the driver seat, is at the OFF position above the pump output in the case where the vehicle is travelling and the main switch 14 of the vehicle, provided at the driver seat, is at the ON position.

Figure 4:
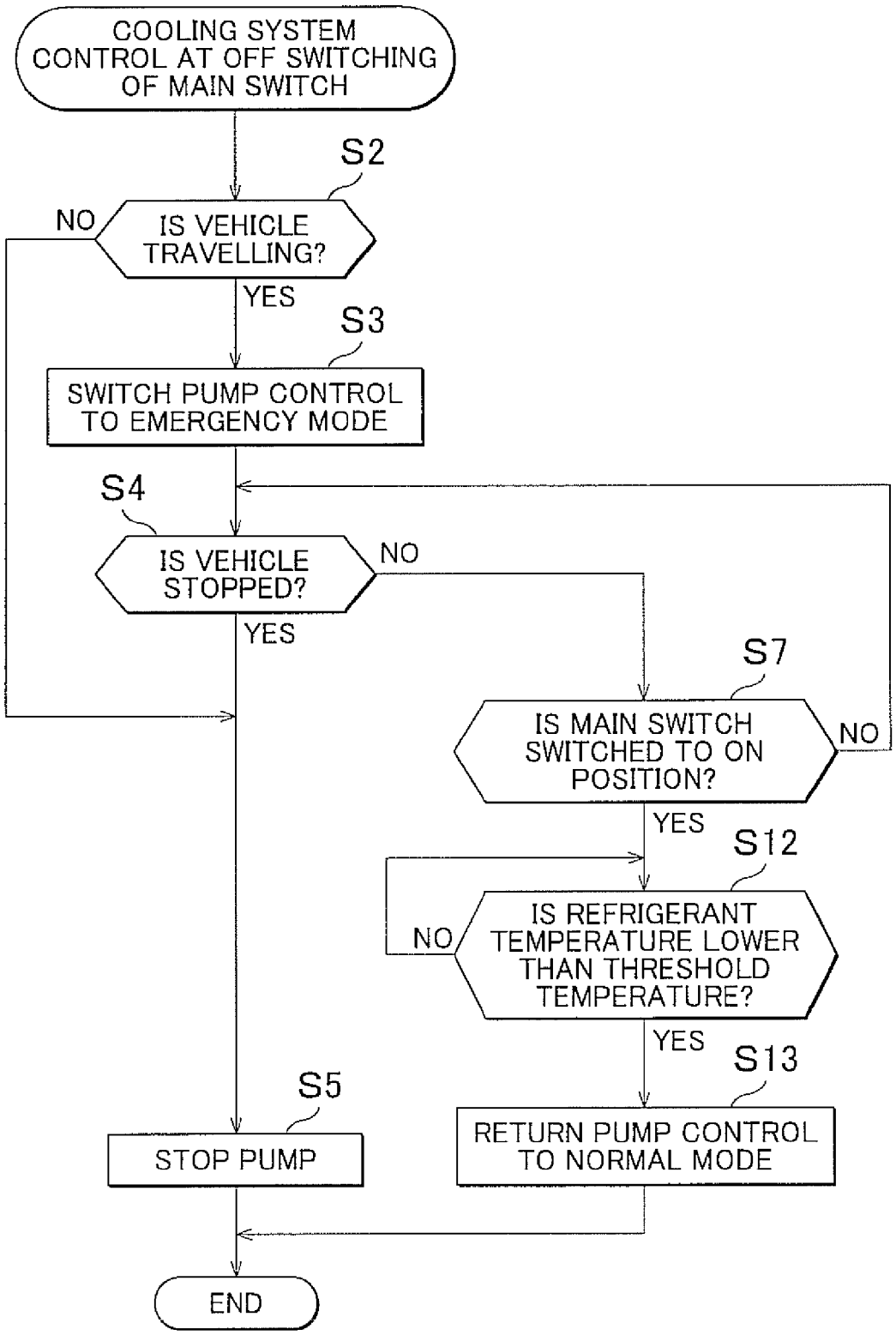
FIG. 4 is a flowchart of control over the cooling system according to an alternative embodiment.

An alternative embodiment of the cooling system process shown in FIG. 2 will be described. FIG. 4 shows a flowchart of the process according to the alternative embodiment. In this alternative embodiment, the processes of steps S2 to S5 are the same as those of the cooling system process (FIG. 2) in the above-described embodiment.

When the main switch 14 is switched from the ON position to the OFF position while travelling, the controller 12 switches pump control to the emergency mode (S3) and then waits (keeps the pump control mode in the emergency mode) until the vehicle is stopped (YES in S4) or the main switch 14 is returned to the ON position again (YES in S7). Even after the main switch 14 is switched to the ON position again, until the refrigerant temperature becomes lower than the predetermined threshold temperature, the controller 12 keeps the pump control mode in the emergency mode (NO in S12). When the refrigerant temperature becomes lower than the predetermined threshold temperature, the controller 12 returns the pump control mode to the normal mode (YES in S12, and S13).

In the above-described alternative embodiment, when the main switch 14 is switched from the ON position to the OFF position while travelling, the pump 10 is driven at an output higher than the output upper limit value during normal times. After that, even when the main switch 14 is switched to the ON position again, until the refrigerant temperature becomes lower than or equal to the threshold temperature, the pump output is kept high. In this alternative embodiment, even when the temperatures of the inverter 3 and motor 6 increase at the time when the main switch 14 is switched from ON to OFF and then switched to ON again while travelling, the pump 10 is driven at a high output until the refrigerant temperature returns to a normal temperature state. By so doing, the inverter 3 and the motor 6 are quickly cooled.

A second embodiment will be described with reference to FIG. 5. In the first embodiment, when the main switch 14 is switched from ON to OFF while travelling, the pump is driven in the emergency mode. An electric vehicle according to the second embodiment powerfully operates the pump when the main switch 14 is switched from OFF to ON while travelling. The hardware configuration of the electric vehicle according to the second embodiment is the same as the configuration of FIG. 1. The process executed by the controller 12 according to the second embodiment is shown in FIG. 5.

Figure 5:
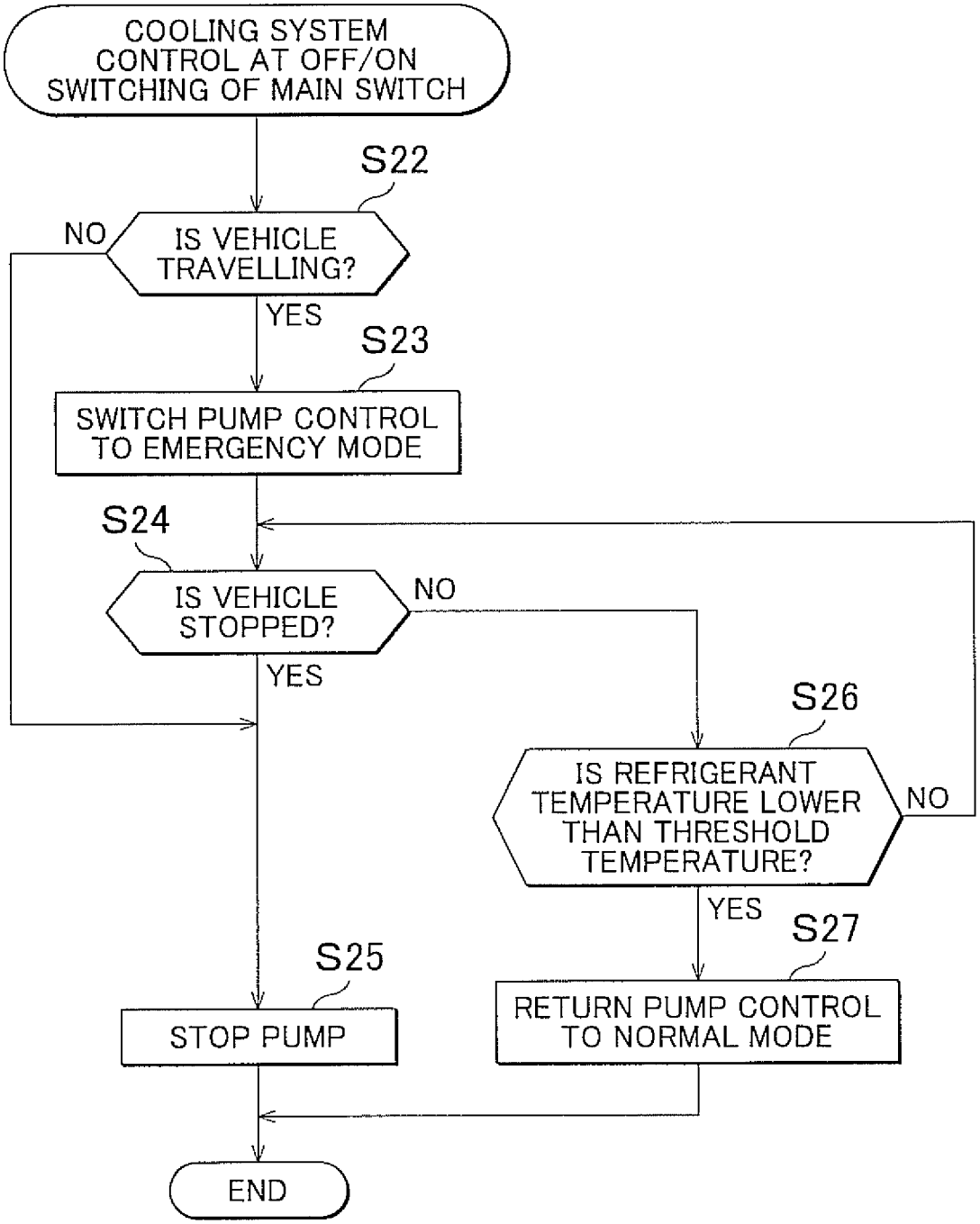
FIG. 5 is a flowchart of control over the cooling system according to a second embodiment.

The process of FIG. 5 is started up when the main switch 14 is switched from the OFF position to the ON position. The controller 12 initially checks whether the vehicle is travelling (S22). When the vehicle is stopped (NO in S22), the controller 12 stops the pump 10 and ends the process (S25). When the vehicle is travelling (YES in S22), the controller 12 switches output control over the pump 10 from the normal mode used during normal times to the emergency mode (S23). The details of the normal mode and the emergency mode are the same as those in the case of the first embodiment. As shown in FIG. 3, in the emergency mode, the controller 12 drives the pump 10 at "super Hi" output irrespective of the refrigerant temperature. As shown in FIG. 3. "super Hi" is higher than any pump output in the normal mode. That is, in the electric vehicle according to the second embodiment, when the main switch 14 is switched from the OFF position to the ON position while travelling, the controller 12 increases the output of the pump 10. By so doing, when the main switch 14 is switched from OFF to ON while travelling, the controller 12 increases the output of the pump 10 in preparation for an increase in the temperatures of the inverter 3 and motor 6 thereafter.

After control over the pump 10 is switched to the emergency mode (S23), the controller 12 monitors whether the vehicle is stopped (S24). When the vehicle is stopped (YES in S24), the controller 12 stops the pump 10 (S25), and ends the process. Note that, when the pump 10 is stopped, the controller 12 returns the control mode switched in step S23 from the emergency mode to the normal mode.

After pump control is switched to the emergency mode (S23), when the refrigerant temperature becomes lower than a predetermined threshold temperature even while travelling (YES in S26), the controller 12 returns control over the pump 10 to the normal mode, and returns to pump control during normal travelling (S27). When the refrigerant temperature is sufficiently low, it is not necessary to excessively cool the motor 6 and the inverter 3 by keeping the pump output at "super Hi". Here, the predetermined threshold temperature is, for example, 10 [° C.], as in the case of the first embodiment. As shown in FIG. 3, in the normal mode, when the refrigerant temperature is lower than 10 [° C.], the pump 10 is stopped, so, when affirmative determination is made in step S26 and the process proceeds to step S27, the controller 12 stops the pump 10.

The important point in the technique disclosed in the specification will be described. It is desirable to combine the process of the flowchart of FIG. 2 with the process of the flowchart of FIG. 4. That is, when the main switch 14 is switched from the ON position to the OFF position while travelling, the controller drives the pump 10 at an output higher than the output upper limit value during normal times, and, when the refrigerant temperature is decreased even while travelling, the controller returns pump control to the normal mode (FIG. 2, YES in S6, and S8). On the other hand, even when the main switch 14 is returned to the ON position again while travelling, the controller drives the pump 10 at a high output until the refrigerant temperature is returned to a normal temperature state (FIG. 4, NO in S12). In this case, the threshold temperature in step S6 in FIG. 2 may be different from the threshold temperature in step S12 in FIG. 4. Typically, the threshold temperature in step S6 in FIG. 2 may be set so as to be lower than the threshold temperature in step S12 in FIG. 4.

In the process of FIG. 2 and the process of FIG. 5, after pump control is switched to the emergency mode, when the refrigerant temperature is lower than the threshold temperature, pump control is immediately returned to the original mode. Thus, when the refrigerant temperature is lower than the threshold temperature, the pump control mode substantially remains in the normal mode even while travelling.

In the processes of FIG. 2, FIG. 4 and FIG. 5, when the vehicle speed is lower than a predetermined speed (threshold speed), it is desirable to keep pump control in the normal mode without switching pump control to the emergency mode. When it is estimated that the vehicle speed is low and the temperatures of the motor 6 and inverter 3 do not increase thereafter, it is not necessary to switch pump control.

In the embodiment, the controller changes pump output on the basis of the refrigerant temperature. Instead of the refrigerant temperature, pump output may be adjusted on the basis of the temperature of the inverter or the temperature of the motor.

In addition, the cooling system according to the embodiment is configured to cool both the inverter 3 and the motor 6. The technique disclosed in the specification may be applied to a cooling system that cools at least one of the inverter and the motor. Furthermore, the vehicle according to the embodiment is a single-motor electric vehicle, and the technique disclosed in the specification is desirably applied to a hybrid vehicle that includes a wheel drive motor and an engine.

The embodiment of the invention is described in detail above; however, it is just illustrative and not intended to limit the scope of the claims. The technique recited in the appended claims encompasses various modifications, alterations and improvements of the above described specific examples. The technical elements described in the specification and the drawings exhibit technical utility alone or in various combinations and are not limited to the combinations described in the appended claims. In addition, the technique described in the specification and the drawings achieves multiple purposes at the same time, and it also has technical utility by achieving one of those purposes.

What is claimed is:

1. An electric vehicle comprising:

a motor configured to be able to regenerate electric power from kinetic energy of the vehicle;

an inverter configured to supply electric power to the motor;

a main battery;

a main relay positioned between the inverter and the main battery, the main relay is switchable between a closed position and an open position, in the closed position the main relay connects the inverter to the main battery, in the open position the main relay disconnects the inverter from the main battery;

an ignition switch positionable in an OFF position and an ON position, in the OFF position the main relay is open, in the ON position the main relay is closed;

a pump configured to deliver refrigerant to at least one of the motor and the inverter; and a controller configured to control the pump, the controller configured to activate the pump when the ignition switch of the vehicle is in the OFF position and the vehicle is travelling, the controller configured to stop the pump when the ignition switch of the vehicle is in the OFF position and the vehicle is stopped, and the controller configured to increase a pump output when the ignition switch of the vehicle is in the OFF position compared to a pump output when the ignition switch of the vehicle is in the ON position while traveling.

2. The electric vehicle according to claim 1, wherein when the ignition switch of the vehicle is in the ON position while travelling, the controller limits the pump output at or below a predetermined pump output upper limit value, and when the ignition switch is in the OFF position while travelling, the controller drives the pump at an output higher than the pump output upper limit value irrespective of the pump output upper limit value.

3. The electric vehicle according to claim 2, wherein the controller monitors at least one of a temperature of the inverter, a temperature of the motor and a temperature of the refrigerant, and when the monitored temperature becomes lower than a predetermined threshold, the controller limits the pump output at or below the pump output upper limit value.

4. The electric vehicle according to claim 1, wherein the ignition switch is provided at a driver seat.

5. The electric vehicle according to claim 1, wherein the ignition switch is operated by a driver.

6. An electric vehicle comprising:

a motor configured to be able to regenerate electric power from kinetic energy of the vehicle;

an inverter configured to supply electric power to the motor;

a main battery;

a main relay positioned between the inverter and the main battery, the main relay is switchable between a closed position and an open position, in the closed position the main relay connects the inverter to the main battery, in the open position the main relay disconnects the inverter from the main battery;

an ignition switch positionable in an OFF position and an ON position, in the OFF position the main relay is open, in the ON position the main relay is closed;

a pump configured to deliver refrigerant to at least one of the motor and the inverter; and a controller configure to control the pump, the controller configured to increase a pump output when the ignition switch of the vehicle is switched from the OFF position to the ON position while travelling.

7. The electric vehicle according to claim 6, wherein the ignition switch is provided at a driver seat.

8. The electric vehicle according to claim 6, wherein the ignition switch is operated by a driver.

9. A control method for an electric vehicle that includes: a motor configure to be able to regenerate electric power from kinetic energy of the vehicle; an inverter configured to supply electric power to the motor; a main battery; a main relay positioned between the inverter and the main battery, the main relay is switchable between a closed position and an open position, in the closed position the main relay connects the inverter to the main battery, in the open position the main relay disconnects the inverter from the main battery; an ignition switch positionable in an OFF position and an ON position, in the OFF position the main relay is open, in the ON position the main relay is closed; and a pump configure to deliver refrigerant to at least one of the motor and the inverter, comprising:

activating the pump when the ignition switch of the vehicle is in the OFF position and the vehicle is travelling, and stopping the pump when the ignition switch of the vehicle is in the OFF position and the vehicle is stopped, wherein a pump output when the ignition switch of the vehicle is in the OFF position while traveling is increased compared to a pump output when the ignition switch of the vehicle is in the ON position while traveling.

10. The control method according to claim 9, further comprising:

limiting the pump output at or below a predetermined pump output upper limit value when the ignition switch of the vehicle is in the ON position while travelling; and driving the pump at an output higher than the pump output upper limit value irrespective of the pump output upper limit value when the ignition switch is in the OFF position while travelling.

11. The control method according to claim 10, further comprising:

monitoring at least one of a temperature of the inverter, a temperature of the motor and a temperature of the refrigerant; and limiting the pump output at or below the pump output upper limit value when the monitored temperature becomes lower than a predetermined threshold.

12. The control method according to claim 9, wherein the ignition switch is operated by a driver.

13. A control method for an electric vehicle that includes: a motor configured to be able to regenerate electric power from kinetic energy of the vehicle; an inverter configured to supply electric power to the motor; a main battery; a main relay positioned between the inverter and the main battery, the main relay is switchable between a closed position and an open position, in the closed position the main relay connects the inverter to the main battery, in the open position the main relay disconnects the inverter from the main battery; an ignition switch positionable in an OFF position and an ON position, in the OFF position the main relay is open, in the ON position the main relay is closed; and a pump configured to deliver refrigerant to at least one of the motor and the inverter, comprising:

increasing a pump output when the ignition switch of the vehicle is switched from the OFF position to the ON position while travelling.

14. The control method according to claim 13, wherein the ignition switch is operated by a driver.

* * * * *